United States Patent [19]

Bottemiller et al.

[11] 4,371,142

[45] Feb. 1, 1983

[54] ROCKING CHAIR

[75] Inventors: Donald L. Bottemiller; John K. Miles, both of Wadena, Minn.

[73] Assignee: Homecrest Industries Incorporated, Wadena, Minn.

[21] Appl. No.: 164,824

[22] Filed: Jun. 30, 1980

Related U.S. Application Data

[63] Continuation-in-part of Ser. No. 907,810, May 19, 1978, abandoned.

[51] Int. Cl.[3] ..... F16M 13/00

[52] U.S. Cl. ..... 248/573; 248/622

[58] Field of Search ..... 248/573, 574, 622, 628, 248/629

[56] References Cited

U.S. PATENT DOCUMENTS

| | | | |
|---|---|---|---|
| 163,287 | 5/1875 | Wheeler et al. | 248/629 |
| 183,366 | 10/1876 | Born | 297/264 |
| 201,087 | 3/1878 | Biersdorf | 297/264 |
| 239,754 | 4/1881 | Flinn | 297/264 |
| 354,042 | 12/1886 | Connolly | 297/288 X |
| 451,490 | 5/1891 | Kade | 297/264 |
| 955,220 | 4/1910 | Stewart | 248/618 |
| 1,962,464 | 6/1934 | Richsteig | 248/628 |
| 2,334,618 | 11/1943 | Foscue | 297/268 |
| 2,913,038 | 11/1959 | McDerby | 248/628 |
| 4,119,343 | 10/1978 | Pentzien | 297/264 |
| 4,141,530 | 2/1979 | Ward | 248/622 X |

*Primary Examiner*—William H. Schultz

*Attorney, Agent, or Firm*—Kinney, Lange, Braddock, Westman and Fairbairn

[57] ABSTRACT

A rocking chair includes a chair which is carried with respect to a chair base by a flexible sheet connected between the chair base and the chair. The flexible sheet supports the weight of the chair and its occupant while permitting rocking of the chair back and forth in a plane normal to the major surface of the flexible sheet. The flexible sheet is preferably inclined with respect to the vertical at an angle of between 5° to 15°. Stops are provided which limit the flexing of the flexible sheet so that the occupant of the chair cannot tip the chair while rocking.

8 Claims, 10 Drawing Figures

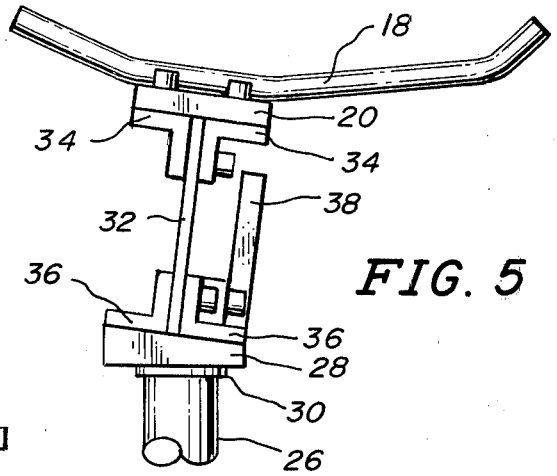
FIG. 5
FIG. 4
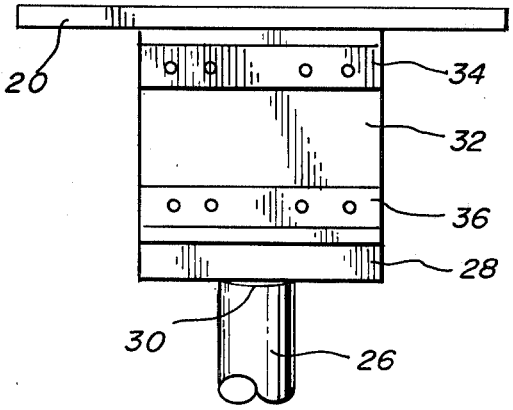
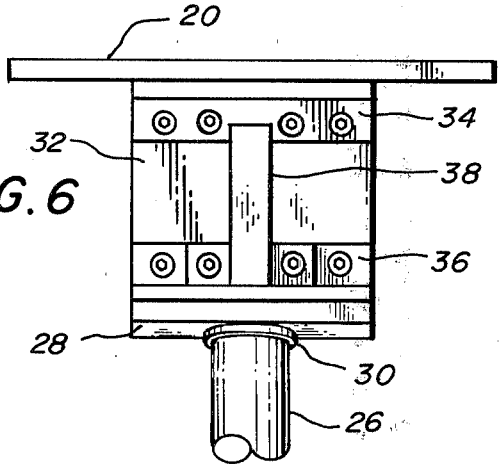
FIG. 6
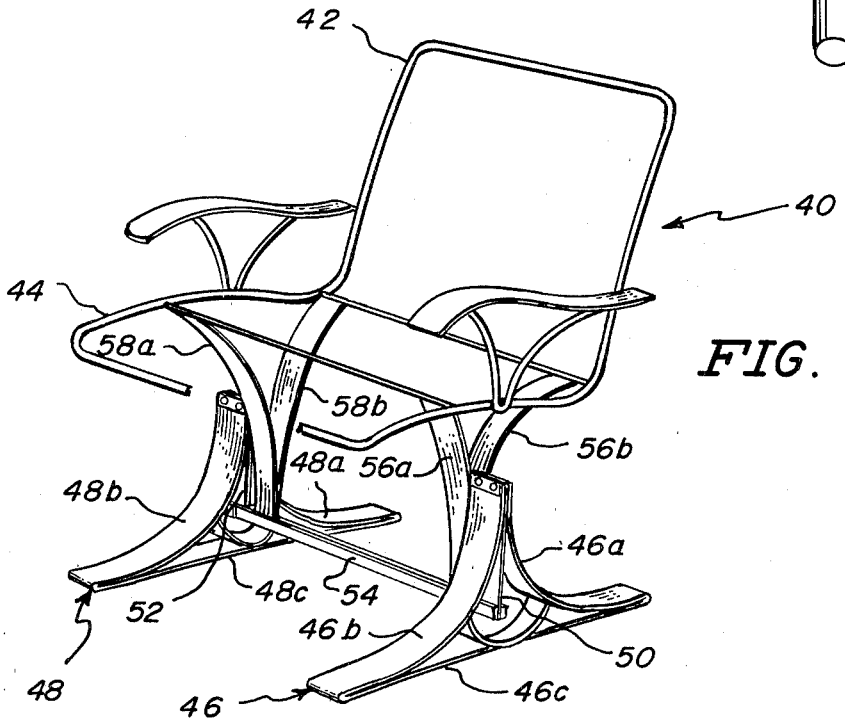
FIG. 7

ROCKING CHAIR

This specification is a continuation in part of our prior application Ser. No. 907,810 filed May 19, 1978 now abandoned.

BACKGROUND OF THE INVENTION

The present invention relates to rocking chairs in which a chair seat rocks with respect to a chair base.

Rocking chairs of various types have been known for many years. One type of rocking chair which is well known has a base which sits on the floor and is stationary. A rocking mechanism is provided to allow the chair to rock with respect to the stationary chair base. In the past, this mechanism has often included cooperating rocking surfaces on the chair and chair base and a spring mechanism which holds the two sections together in such a way that they rock with respect to one another. U.S. Pat. Nos. 183,366 by Born; 201,087 by Beiersdorf; 236,754 by Flinn; 354,042 by Connolly et al; and 451,490 by Kade illustrate examples of rocking chairs of this type.

A highly successful type of rocking and reclining chair is illustrated in U.S. Pat. Nos. 2,916,084 by Bottemiller et al and 4,068,888 by Bottemiller, both of which are assigned to the same assignee as the present application. In these rocking and reclining chairs, the chair seat is supported by a coil spring secured to the chair base so as to permit rocking of the chair with respect to the stationary chair base.

Recently, it has been proposed to use one or more strips of a flexible plastic material, such as a moldable epoxy glass laminate to support the chair seat with respect to the chair base. Typical arrangements of this type are shown in the Pentzien U.S. Pat. Nos. 4,119,343 and the Ward 4,141,530. In these prior structures, however, the flexible sheet or sheets are disposed either vertically or at a very substantial angle with respect to the vertical. With such a disposition of a strip however, the rocking action is not as satisfactory as might be desired. Where the strip is disposed vertically, there is a region of instability immediately about the vertical position of the strip. Where the strip is disposed at a substantial angle with respect to the vertical, the strip tends to be bent excessively and the rocking action is relatively "soft". Furthermore, with a device of this type, it is very essential to employ an adequate stop means to limit the flexing of the strip.

SUMMARY OF THE INVENTION

The present invention is a highly advantageous rocking chair assembly of the type which uses a flexible sheet to both support the chair and to permit rocking of the chair with respect to the chair base in a plane normal to a major surface of the flexible sheet. Stop means limit the flexing of the flexible strip to prevent the weight of the chair and its occupant from shifting to a position which would cause tipping of the chair base.

In the preferred embodiments, the flexible sheet is connected between the chair base and the chair and disposed at an angle of between 5 to 15 degrees with respect to the vertical so that the strip is substantially in compression as a result of supporting the weight of the chair and any occupant of the chair. Because of the slight angle of inclination of the strip, the strip is normally flexed somewhat. In other words, the sheet is biased for backward rocking. At the same time the angle of inclination is small enough that the strip always remains primarily under compression.

Sway from side to side is not permitted because the flexible sheet permits rocking only in the plane which is normal to the major surface of the sheet.

BRIEF DESCRIPTION OF THE DRAWINGS

FIGS. 4, 5, and 6 are front, side, and rear detail views of a portion of the rocking chair of FIGS. 1–3, including the flexible sheet and stop.

FIG. 7 is a perspective view of another preferred embodiment of the present invention.

DETAILED DESCRIPTION OF THE PREFERRED EMBODIMENTS

Figure 1:
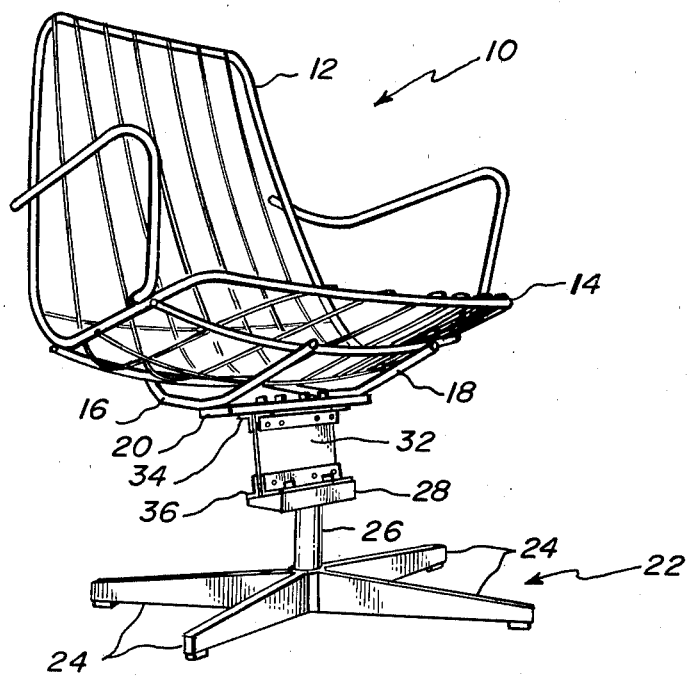
FIG. 1 is a perspective view of one preferred embodiment of the rocking chair of the present invention.

FIG. 1 shows one preferred embodiment of the rocking chair of the present invention. The rocking chair includes a chair 10 having a chair back portion 12, and a chair seat portion 14. Attached to the bottom of chair seat portion 14 are supports in the form of rods 16 and 18, which are bent to conform with the under side of the seat portion 14 and which are in turn connected to seat plate 20.

Figure 3:
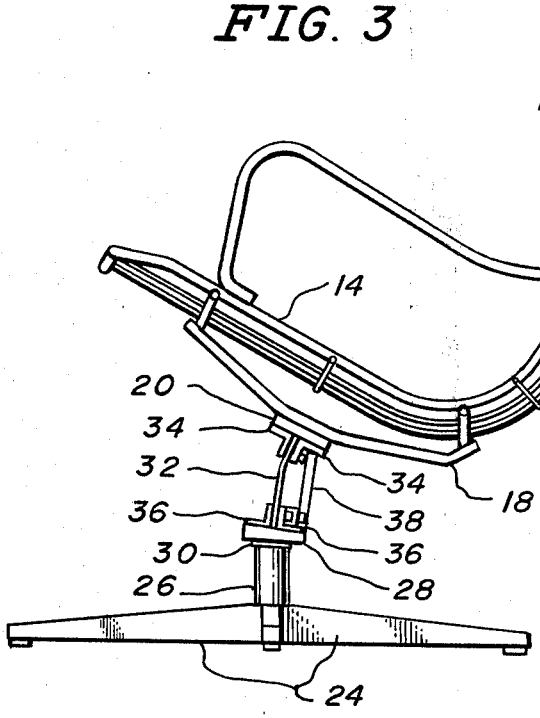
FIGS. 2 and 3 are side views of the rocking chair of FIG. 1 illustrating the chair in two different rocking positions.
Figure 2:
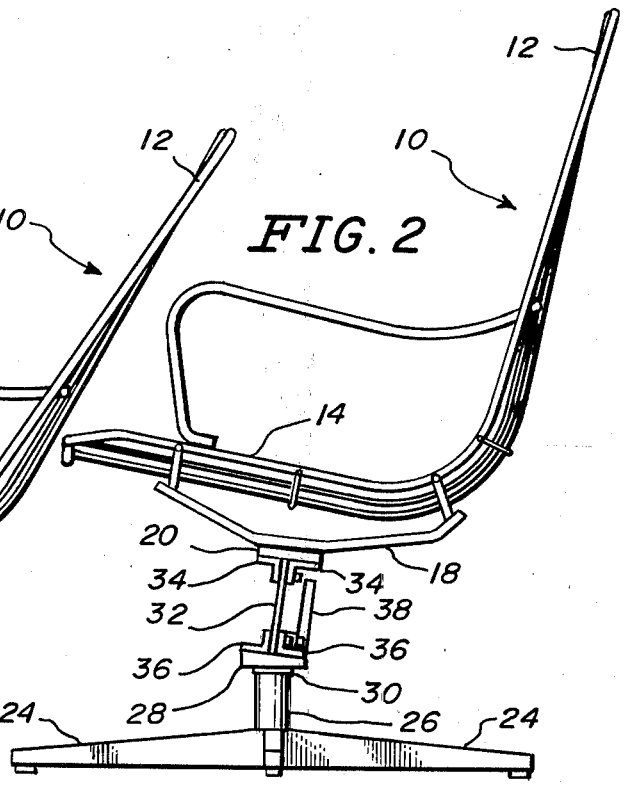

The rocking chair also includes a chair base 22, formed by legs 24, tubular base plate support member 26, base plate 28, and washer 30 (shown in FIGS. 2 and 3). Legs 24 are disposed at right angles to one another and are attached to tubular base plate support member 26. Base plate 28 is swivelly mounted in tubular base plate support member 26. Base plate 28 has a stub shaft secured thereto (not shown) which extends into tubular base plate support member 26. Washer 30 is formed of a low friction material and is interposed between base plate 28 and the top of base tubular member 26 so that base plate 28 readily turns with respect to the remainder of base 22.

Connected between seat plate 20 and base plate 28 is a flexible sheet 32. In a preferred embodiment, flexible sheet 32 is a material formed of epoxy impregnated with continuous glass filaments disposed in parallel alignment. One commercial form of the type of material is "Scotch Ply" reinforced plastic manufactured by 3M Company.

Flexible sheet 32 is attached to seat plate 20 by a pair of brackets 34 and to base plate 28 by a pair of brackets 36. Brackets 34 (and also brackets 36) are shown as being clamped against the sheet 32 by bolts, although any other form of clamping means can be utilized. As shown in FIG. 1, flexible sheet 32 provides the sole support of chair 10 with respect to base 22. In addition, flexible sheet 32 permits rocking of chair 10 with respect to base 22 in a plane perpendicular to the major surfaces of sheet 32. No sideward sway of the chair 10 with respect to base 22 is permitted, however, due to the characteristics of sheet 32, which permit flexing in only one plane.

Base plate 28 is generally trapezoidal in cross section and has an inclined upper wall which slopes downwardly proceeding from the front to the rear. As a result, flexible sheet 32 is slightly inclined rearwardly from its bottom to its top when in its normal position. Any weight applied to chair 10 by an occupant, therefore, tends to cause chair 10 to rock backward rather than forward. The inclined orientation of flexible sheet 32 in effect biases sheet 32 toward backward rocking (which, of course, is desired). It has been found that a strictly vertical orientation of sheet 32 is compression can lead to unpredictable rocking when weight is applied to chair 10. The inclined orientation of sheet 32 overcomes and eliminates this tendency.

It has been found experimentally that the optimum angle between the plane of the flexible sheet 32 and vertical is between approximately 5° and approximately 15°. It is found that if the angle is much less than 5°, the unpredictable rocking referred to above tends to occur. If, on the other hand, the angle is greater than 15°, the bending action applied to the sheet 32 becomes excessive so that the rocking action is relatively "soft". Furthermore, there is a tendency for the excessive bending action to decrease the ultimate life of the strip 32. It has been found the optimum angle is approximately 10°.

FIGS. 2 and 3 illustrate the operation of the rocking chair of FIG. 1. In FIG. 2, chair 10 is in its normal position. It can be seen that flexible sheet 32 is in compression due to the compressive load of the weight of chair 10 (and also the weight of the occupant of the chair, if any).

As shown in both FIGS. 2 and 3, the present invention also includes a stop 38 which is attached to bracket 36 and extends upward. In the normal position shown in FIG. 2, the top end of stop 38 does not engage bracket 34. When the chair is rocked backward, as shown in FIG. 3, flexible sheet 32 bends or flexes, permitting rocking of the chair backward. This backward rocking is permitted until the top end of the stop 38 engages bracket 34. At this point, no further backward movement of chair 10 is permitted.

FIGS. 4, 5 and 6 show the portion of the rocking chair including flexible sheet 32 and stop 38 in greater detail. In these figures, the chair is in its normal position, so that the top end of stop 38 is not engaging bracket 34. The length of stop 38 depends, of course, on the size of base 22 with respect to chair 10, and the permissible distance which chair 10 may rock backwards without shifting the center of balance of the rocking chair so that the base 22 will be tipped upward at its front end.

MODIFICATIONS OF FIGS. 7 THROUGH 10

While the arrangement of FIGS. 1 through 6 is the preferred embodiment, FIGS. 7 through 10 show other modifications of the invention.

In the embodiment of FIG. 7, there is shown a chair 40 having a back portion 42 and a seat portion 44. For simplicity, only the outline of the framing of chair 40 is shown in FIG. 7. Vertical or horizontal cross members are typically provided for support.

The rocking chair of FIG. 7 also includes a base formed of two base members 46 and 48, each of which has two spaced legs. The legs of base member 46 are designated **46*a* and 46*b*, respectively, and the bottom plate of base member 46 is designated 46*c*. Similarly, the two legs of base member 48 are designated 48*a* and 48*b*, and the base plate is designated 48*c*. Attached at the top of legs 46*a* and 46*b* and extending vertically downward is first flexible sheet 50, which is preferably of flexible sheet material similar to that used for flexible member 32 of FIGS. 1–6. A second flexible sheet 52, similar to sheet 50, is attached at the top of legs 48*a* and 48*b* and extends vertically downward. Crossbar 54 is attached to the lower ends of flexible sheet 52 and 54. Attached to the crossbar 54 and extending upward to seat 44 are legs 56*a*, 56*b*, 58*a* and 58*b*. Legs 58*a* and 58*b* are attached near one end of crossbar 54 and form a generally triangular support for one side of chair 44. Similarly, legs 58*a* and 58*b* are attached near the opposite end of crossbar 54 and provide a generally triangular support for the opposite side of chair 44 from legs 56*a* and 56*b***.

As can be seen, flexible sheets 50 and 52 in FIG. 7 support the entire weight of chair 40 and are always in tension. This is in contrast with the embodiment shown in FIGS. 1–6, in which sheet 32 is always in compression. Also in contrast with the embodiment shown in FIGS. 1–6, sheets 50 and 52 are oriented vertically when in their normal position. The biasing provided by inclining the flexible sheet (as in FIG. 106) is not needed in FIG. 7 because sheets 50 and 52 are in tension rather than compression. They do not exhibit the unpredictable rocking which can be a problem when a vertical sheet is in compression.

Like the embodiment shown in FIGS. 1–6, flexible sheets 50 and 52 permit rocking of the chair 40 with respect to base members 46 and 48 only in a plane normal to the major surfaces of sheets 50 and 52. In the embodiment shown in FIG. 7, the positive stops for both forward and rearward rocking are provided by legs **46*a* and 46*b*, and legs 48*a* and 48*b*. The most forward rocking position is determined by crossbar 54 engaging legs 46*a* and 48*a*. The most rearward rocking position is defined by crossbar 54 engaging legs 46*b* and 48*b***.

Figure 8:
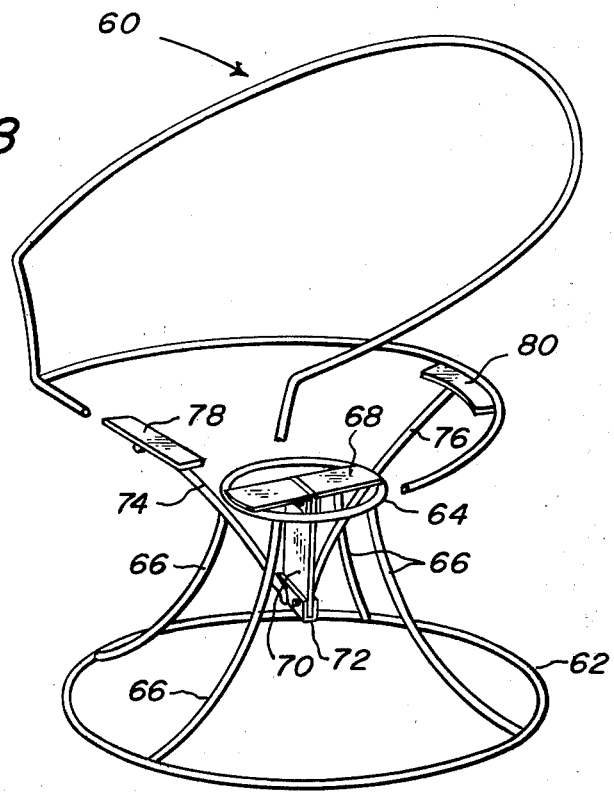
FIG. 8 is a perspective view of still another preferred embodiment of the present invention.

FIG. 8 shows another embodiment of the present invention which, like the embodiment shown in FIG. 7, uses a flexible sheet in tension to support a chair. The rocking chair of FIG. 8 includes a chair 60. Only the framing which outlines the chair 60 is shown, but of course, vertical and/or horizontal members will be provided to fully define the chair.

In FIG. 8, the base includes a lower base ring 62, an upper base ring 64, and legs 66 which support upper base ring 64 above lower base ring 62. Upper mounting bracket 68 is attached to upper base ring 64 and to the upper end of flexible sheet 70. Lower bracket 72 is attached to the lower end of flexible sheet 70. Support rods 74 and 76 are attached to lower brackets 72 and extend upward to brackets 78 and 80, respectively, which are attached to the seat of chair 60.

Figure 9:
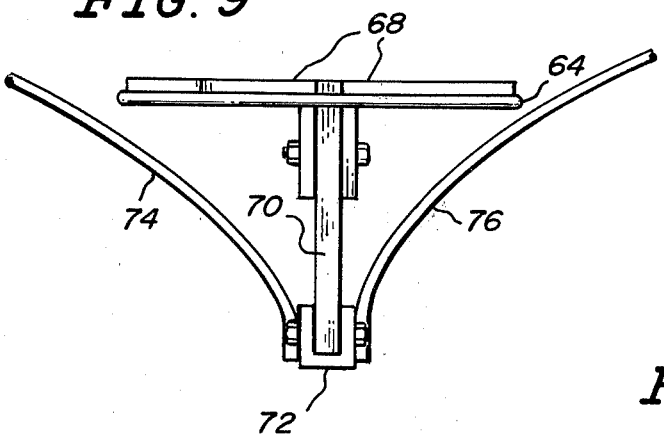
FIG. 9 is a side detail view of the chair of FIG. 8, including the flexible sheet.

FIG. 9 shows a side view of a portion of the chair of FIG. 8. In particular, upper base ring 64, upper mounting bracket 68, flexible sheet 70, lower mounting bracket 72, and support rods 74 and 76 are shown. As illustrated in FIGS. 8 and 9, sheet 70 is under tension while supporting the weight of chair 60 and its occupant. Upper base ring 64 acts together with support rods 74 and 76 as the positive stops for forward and rearward rocking of chair 60. The rearward rocking is limited when support rod 74 engages the front portion of upper base ring 64. Similarly, the forward rocking of chair 60 is limited by rear support rod 76 engaging the back portion of upper base ring 64. As in the previous embodiments, rocking is limited to a plane normal to the major surfaces of flexible sheet 70. Also as in the previous embodiments, flexible sheet 70 supports the entire weight of chair 60 as well as the occupant of chair 60.

Other embodiments similar to FIG. 8, of course, are possible. For example, in one advantageous embodiment, multiple front and rear support rods are used in place of single front and rear support rods 74 and 76, respectively. The multiple support rods provide greater stability and act in a similar manner in limiting the forward and rearward rocking of chair 60.

Figure 10:
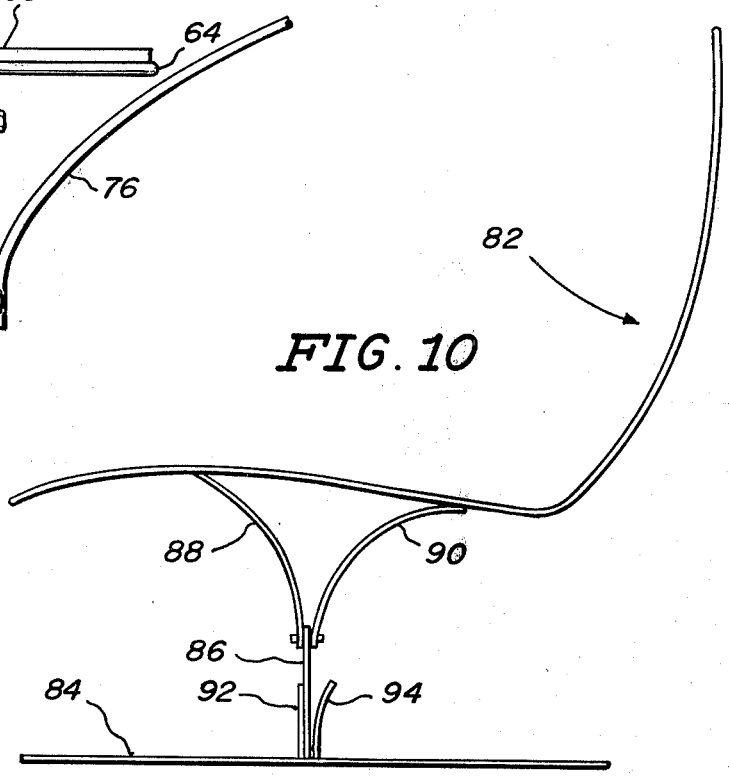
FIG. 10 is a side view of still another preferred embodiment of the present invention.

FIG. 10 shows another embodiment of the present invention. In this embodiment, chair 82 rocks with respect to base 84. Flexible sheet 86 is connected to chair 82 by curved support members 88 and 90. Front and rear stops 92 and 94 are secured to base 84 and are also fastened at their lower end to the lower end of flexible sheet 86. Front and rear stops 92 and 94 limit the rocking of chair 82 with respect to base 84.

The embodiment shown in FIG. 10 is similar to the embodiment shown in FIGS. 1–6 in that flexible sheet 86 is in compression due to the weight of chair 82 and its occupant, if any. The entire weight of chair 82 and its occupant is supported by flexible sheet 86.

Unlike the embodiment shown in FIGS. 1–6, flexible sheet 86 in FIG. 10 is oriented vertically. The problem of unpredictable rocking is somewhat overcome by front stop 92, which is vertical and in contact with the front surface of flexible sheet 86 when flexible sheet 86 is in its normal position. Front stop 92 effectively prevents forward rocking of sheet 86 beyond vertical.

The present invention, as shown in the various embodiments illustrated in FIGS. 1–10, yields a highly advantageous rocking chair structure. First, it is amenable to both swivel type chairs (as illustrated in FIGS. 1–6) and to stationary rockers (FIGS. 7–10).

Second, the present invention provides a much stabler structure than some of the prior art devices employing flexible sheet material for supporting a chair seat from a chair base.

Lastly, due to the stop means employed, the danger of excessive tilting of the rocker is avoided with a very simple type of structure.

Although the present invention has been described with reference to preferred embodiments, workers skilled in the art will recognize that changes may be made in form and detail without departing from the spirit and scope of the invention.

What is claimed is:

1. A rocking chair comprising:

a chair base;

a chair;

flexible plastic sheet means connected between the chair base and the chair for supporting the chair and its occupant and permitting rocking of the chair with respect to the base in a plane essentially normal to a major surface of the flexible sheet means by flexing of the flexible plastic sheet means;

first mounting means for connecting one end of the flexible sheet means to the chair base;

second mounting means for connecting an opposite end of the flexible sheet means to the chair, the flexible sheet means extending generally upwardly from the first mounting means to the second mounting means at a slight inclination rearwardly from a vertical position so that the chair and its occupant apply a primarily compressive load to the flexible plastic sheet means, and stop means comprising cooperating elements on said first and second mounting means, at least one of said elements extending towards the other, said elements normally being spaced but engaging each other when said chair is rocking rearwardly to stop further flexure of the flexible sheet means and thus to prevent the chair and its occupant from achieving a position which would cause tipping of the chair base rearwardly.

2. The rocking chair of claim 1 wherein the cooperating elements of the stop means comprise:

a stop member connected at one end to one of the first and second mounting means and extending toward an element of the other mounting means but not connected at its opposite end to such other mounting means so that the stop means limits the flexing of the flexible sheet means by reason of the stop member engaging said element of the other of the first and second mounting means.

3. A rocking chair comprising:

a chair base comprising chair legs, a chair base plate having an inclined wall and a chair base plate support member for supporting the chair base plate in a position above the chair legs;

a chair;

a chair plate connected to the chair;

flexible plastic sheet means connected between the chair base and the chair for supporting the chair and its occupant and permitting rocking of the chair with respect to the base in a plane essentially normal to a major surface of the flexible sheet means by flexing of the flexible plastic sheet means;

first mounting means for connecting one end of the flexible sheet means to the inclined wall of the chair base plate;

second mounting means for connecting an opposite end of the flexible sheet means to the chair plate, the inclination of the wall of the chair base plate being such that the flexible sheet means extends generally upwardly from the first mounting means to the second mounting means at an angle of from approximately 5 degrees to approximately 15 degrees rearwardly from a vertical position so that the chair and its occupant apply a primarily compressive load to the flexible plastic sheet means, and stop means for limiting the flexing of the flexible sheet means to prevent the chair and its occupant from achieving a position which would cause tipping of the chair base.

4. The rocking chair of claim 3 wherein the chair base plate has an inclined upper wall which slopes downwardly from front to rear at an angle with respect to the horizontal of between approximately 5 degrees and 15 degrees, and wherein the flexible sheet means is connected to the inclined upper wall by a first mounting means such that the flexible sheet means is inclined rearwardly with respect to vertical by said angle of approximately 5 degrees to approximately 15 degrees, from the first mounting means to the second mounting means.

5. The rocking chair of claim 3 wherein the flexible sheet means comprises an epoxy impregnated with glass filaments disposed in parallel alignment.

6. The rocking chair of claim 1 wherein the chair base comprises:

chair legs;

a chair base plate connected to the flexible sheet means by the first mounting means; and a chair base plate support member for supporting the chair base plate in a position above the chair legs.

7. The rocking chair of claim 6 and further comprising;

a chair plate connected to the chair and connected to the flexible sheet means by the second mounting means.

8. The rocking chair of claim 6 in which the chair base plate is swivelly supported from the chair base plate support member.

* * * * *